US007770424B2

(12) United States Patent
Tamezane et al.

(10) Patent No.: US 7,770,424 B2
(45) Date of Patent: Aug. 10, 2010

(54) CYLINDER LOCK DEVICE

(75) Inventors: Takumi Tamezane, Aichi (JP); Toshiharu Katagiri, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 12/187,652

(22) Filed: Aug. 7, 2008

(65) Prior Publication Data

US 2009/0038351 A1 Feb. 12, 2009

(30) Foreign Application Priority Data

Aug. 8, 2007 (JP) ..... 2007-206405

(51) Int. Cl.
*E05B 27/00* (2006.01)

(52) U.S. Cl. ..... 70/492; 70/373; 70/377

(58) Field of Classification Search ..... 70/373, 70/377, 492, 54–56, 416, 417, 448, 450, 70/451, 427, 454, DIG. 43, DIG. 57, 423, 70/455; 109/2, 3, 6–8, 21, 30–32, 38; 49/42, 49/43

See application file for complete search history.

(56) References Cited

U.S. PATENT DOCUMENTS 1,968,555 A * 7/1934 Horne ..... 70/367
2,058,893 A * 10/1936 Ledin ..... 70/492
2,123,940 A * 7/1938 Gray ..... 70/492
2,182,307 A * 12/1939 Behnke ..... 70/80
2,330,929 A * 10/1943 Shinn ..... 70/419
4,074,551 A * 2/1978 Lipschutz ..... 70/492
4,320,639 A * 3/1982 Kleefeldt et al. ..... 70/492
4,426,864 A * 1/1984 Morikawa ..... 70/431
4,761,977 A * 8/1988 Weatherby ..... 70/493
5,088,305 A * 2/1992 Myers ..... 70/369
5,134,871 A * 8/1992 Makino et al. ..... 70/492
5,174,141 A * 12/1992 Ohyabu ..... 70/492
5,438,856 A * 8/1995 Richter et al. ..... 70/492
5,577,409 A * 11/1996 Oyabu et al. ..... 70/379 R
5,934,124 A * 8/1999 Yasuhara ..... 70/492
7,137,280 B2 * 11/2006 Capka et al. ..... 70/492
7,260,965 B2 * 8/2007 Hung ..... 70/339
2006/0000251 A1 * 1/2006 Ceron et al. ..... 70/492
2007/0006623 A1 * 1/2007 Barrenberg et al. ..... 70/492

FOREIGN PATENT DOCUMENTS

JP A-8-004378 1/1996

* cited by examiner

*Primary Examiner*—Suzanne D Barrett
(74) *Attorney, Agent, or Firm*—Scully, Scott, Murphy & Presser, P.C.

(57) ABSTRACT

A cylinder lock device includes a rotor case in a cylindrical shape, a rotor arranged to be rotatable inside the rotor case including a key insert hole being formed to extend in an axial direction, a sleeve arranged to be rotatable between the rotor case and the rotor and having an engaging groove, and a plurality of tumblers provided in the rotor to be movable in a radial direction to engage with the engaging groove of the sleeve when biased to an outer radial direction and to release the engagement with the sleeve by disengaging with the engaging groove when a regular key is inserted into the key insert hole. A position in a circumferential direction and a size of the engaging groove of the sleeve is configured to contact with an inner surface of the engaging groove at a different position in a circumferential direction with respect to at least two tumblers among the plurality of tumblers.

7 Claims, 5 Drawing Sheets

CYLINDER LOCK DEVICE

The present application is based on Japanese Patent Application No. 2007-206405 filed on Aug. 8, 2007, the entire contents of which are incorporated herein by reference.

BACKGROUND OF THE INVENTION

1. Field of the Invention

The present invention relates to a cylinder lock device, in more particular, to a cylinder lock device which is difficult to unlock by an unauthorized picking operation.

2. Related Art

As a cylinder lock device used for the doors or the like of the vehicle, a cylinder lock device having a rotor arranged to be rotatable inside a rotor case in a cylindrical shape and formed such that a key insert hole extends in an axial direction, has been known. In the cylinder lock device, a plurality of tumblers are provided in the rotor to be movable in a radial direction, and each tumbler is biased toward an outer radial direction and engaged with a sleeve when a key is inserted into a key insert hole, each tumbler is moved by a groove of the key. When a regular key is inserted. The engagement of each tumbler with the sleeve is released, so that the rotor and the sleeve are separated from each other to be rotatable. By rotating the key, a lever member is rotated together with the rotor to conduct the locking or unlocking operation.

As a cylinder lock device of this type, a free-wheel mechanism has been proposed, which rotates only a rotor and a sleeve wilt respect to a rotor case when a foreign object such as an unauthorized key or a screwdriver is inserted. A cylinder lock device disclosed by JP-A-8-004378 is provided with a shift factor movable in a radial direction in the rotor, in which this shift factor is engaged with a concave portion formed on an outer peripheral surface of the sleeve biasing to the inner radial direction. Furthermore, it is configured that the sleeve is rotatable with respect to the rotor case by a movement of the shift factor engaged with the sleeve in an outer radial direction when the rotor is rotated by a key other than a regular key.

However, in the cylinder lock device disclosed by JP-A-8-004378, since the tumbler contacts with the rotor when operating each of the tumblers while rotating the rotor, it is possible to find a true position for each tumbler, namely, a position to allow the unlocking by moving the tumbler up and down in this contact state, thus, there is a problem in that it is possible to carry out a so-called unauthorized picking action.

THE SUMMARY OF THE INVENTION

Therefore, the present invention is made in view of the above-mentioned circumstance and an object of the invention is to provide a cylinder lock device having a configuration by which it is possible to control the so-called unauthorized picking action.

According to the present invention, a cylinder lock device comprises: a rotor case in a cylindrical shape;

a rotor arranged to be rotatable inside the rotor case including a key insert hole being formed to extend in an axial direction;

a sleeve arranged to be rotatable between the rotor case and the rotor and having an engaging groove, and a plurality of tumblers provided in the rotor to be movable in a radial direction to engage with the engaging groove of the sleeve when biased to an outer radial direction and to release the engagement with the sleeve by disengaging with the engaging groove when a regular key is inserted into the key insert hole;

wherein a position in a circumferential direction and a size of the engaging groove of the sleeve is configured to contact with an inner surface of the engaging groove at a different position in a circumferential direction with respect to at least two tumblers among the plurality of tumblers.

Preferably, the engaging groove of the sleeve is configured to be two types of contact location in a front-back direction of the axial direction of the key insert hole.

Furthermore, the engaging groove of the sleeve is configured to be two types of contact location in a vertical direction of the axial direction of the key insert hole.

EFFECT OF THE INVENTION

According to present invention, it is possible to provide the cylinder lock device having a configuration by which it is possible to control the so-called unauthorized picking action.

BRIEF DESCRIPTION OF THE DRAWINGS

Next, the present invention will be explained in more detail in conjunction with appended drawings, wherein:

FIGS. 4A, 4B, 4C and 4D are cross sectional views at each position in FIG. 2, wherein FIG. 4A is along A-A line, FIG. 4B is along B-B line, FIG. 4C is along C-C line and FIG. 4D is along D-D line.

DESCRIPTION OF THE PREFERRED EMBODIMENTS

Figure 1:
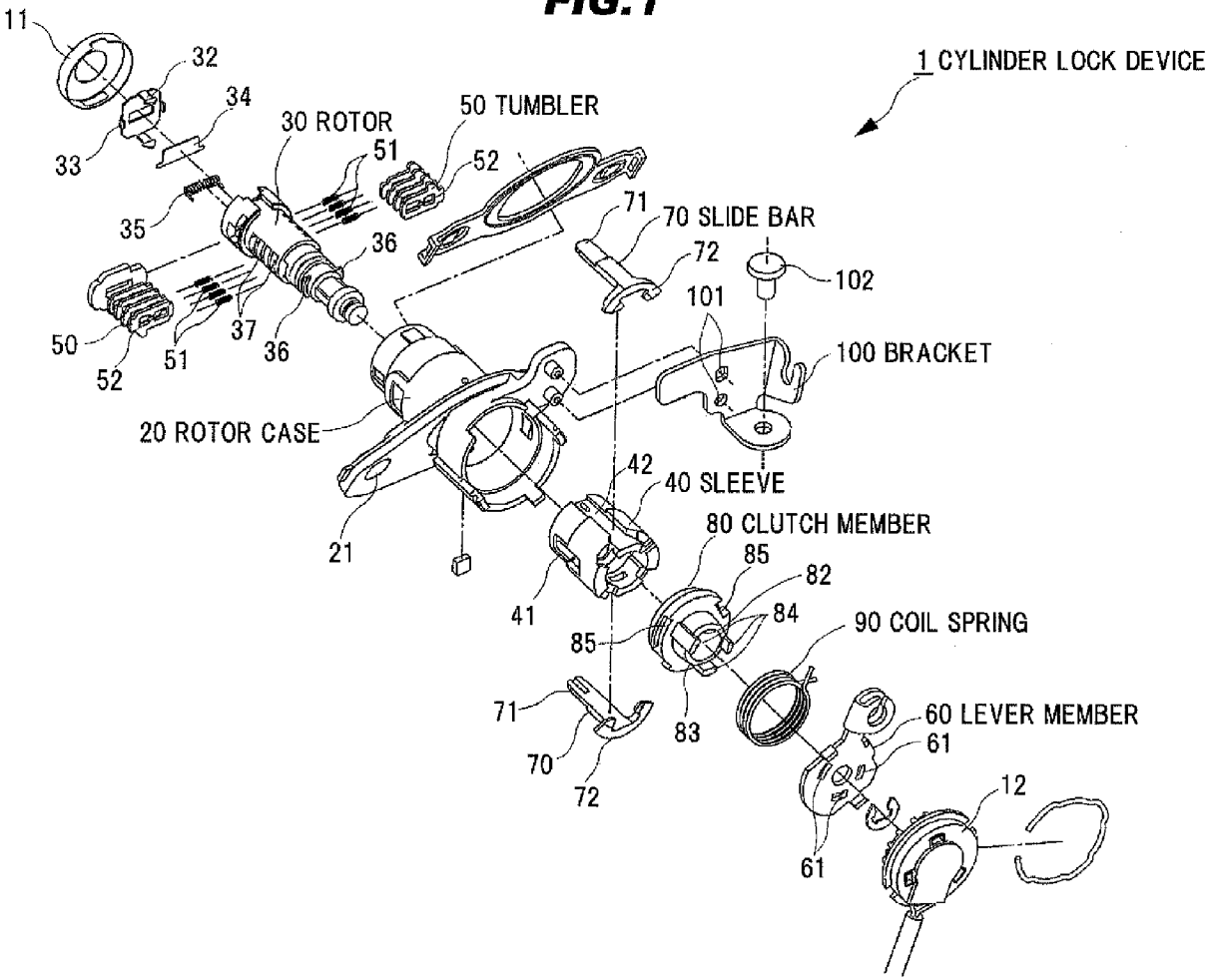
FIG. 1 is an exploded perspective view of a cylinder lock device in a first embodiment according to the present invention.
Figure 2:
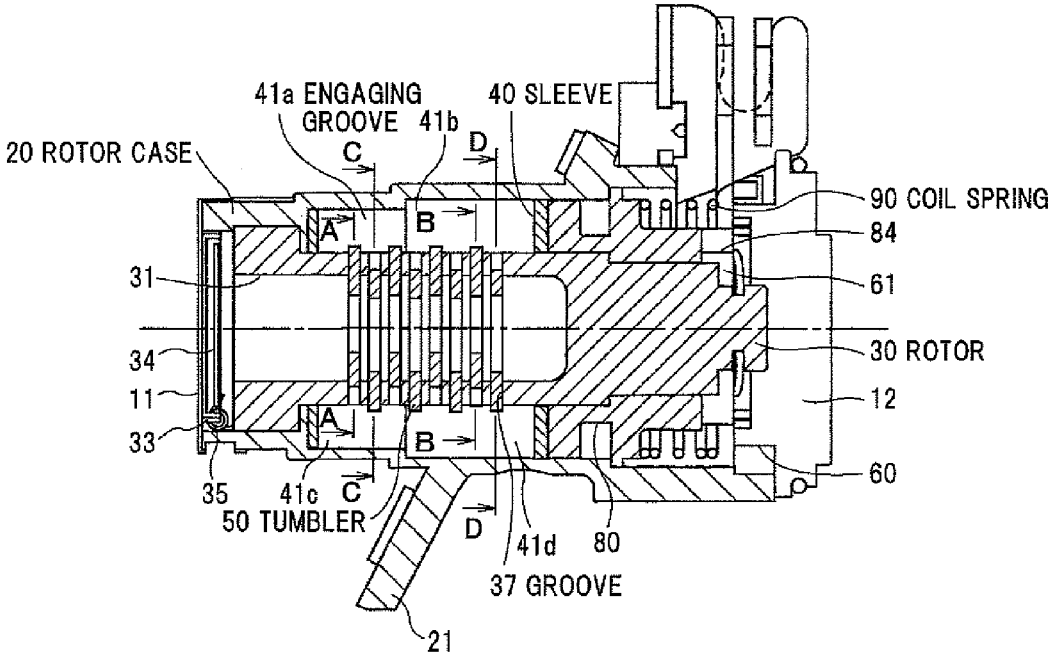
FIG. 2 is a vertical cross-sectional view of the cylinder lock device in an initial state (the state that a key is not inserted)
Figure 3:
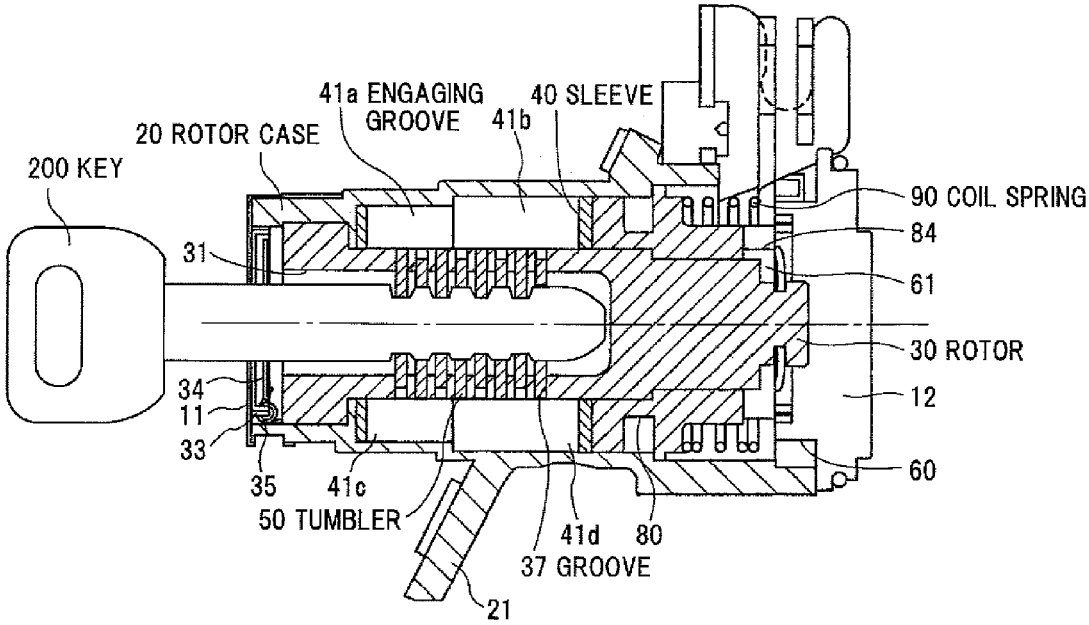
FIG. 3 is a vertical cross-sectional view of the cylinder lock device in the state that a regular is inserted.

FIG. 1 is an exploded perspective view of a cylinder lock device, FIG. 2 is a vertical cross-sectional view of the cylinder lock device in an initial state (the state that a key is not inserted) and FIG. 3 is a vertical cross-sectional view of the cylinder lock device in the state that a regular is inserted. In each cross sectional view, a hatching is appropriately omitted for explanation.

As shown in FIG. 1, this cylinder lock device 1 comprises a rotor case 20 in a substantially cylindrical shape, a rotor 30 arranged to be rotatable inside the rotor case 20, a sleeve 40 arranged to be rotatable between the rotor case 20 and the rotor 30, a tumbler 50 provided to be movable in a radial direction in the rotor 30 and a rotatable lever member 60 arranged facing to the side opposite to the key insert side in the rotor 30. An edge of key insert side of the rotor case 20 is covered with a case cover 11 and an edge opposite to the key insert side is covered with a switch unit 12. In the cylinder lock device 1, if the key is rotated in the state that a regular key 200 is inserted into the rotor 30, the lever member 60 rotates together with the rotor 30. Here, the cylinder lock device 1 is provided with a disengagement mechanism to idle the rotor 30 with respect to the lever member 60 by releasing the engagement of the rotor 30 with the lever member 60 side when the rotor 30 is rotated with a force by an unauthorized key or a screwdriver, namely, a so-called free-wheel system is adopted.

Concretely, as shown in FIG. 1, the cylinder lock device 1 comprises a slide bar 70 as a slide member arranged between the sleeve 40 and the rotor case 20, a clutch member 80 arranged between the rotor 30 and the lever member 60 and a coil spring 90 biasing the clutch member 80 to the rotor 30 side so as to contact with the rotor 30, and the free-wheel mechanism is realized by a cooperation of these components. The cylinder lock device 1 will be explained in detail below.

As shown in FIG. 1, a projecting plate portion 21 in which a plate surface is oriented toward the axial direction is formed on an outer peripheral surface of the rotor case 20. In this projecting plate portion 21, a projection to be inserted into a through-hole 101 formed on a fixing bracket 100 is formed. The bracket 100 is fixed to the vehicle by a bolt 102 and the rotor case 20 is fixed to the vehicle through the bracket.

(Rotor 30)

The rotor 30 is in a substantially cylindrical shape and, as shown in FIG. 2, formed such that the key insert hole 31 extends in the axial direction. As shown in FIG. 1, the key insert side of the rotor 30 is covered with a rotor cover 33 in which a key through-hole 32 is formed at its center. A shutter member 34 to cover the key through-hole 32 is provided on the back side of this rotor cover 33 in the state that the key is not inserted. The shutter member 34 is biased in a direction to block off the key through-hole 32 by a spring 35 for shuttering.

Furthermore, as shown in FIG. 1, convex portions 36 that are engageable with the clutch member 80 are formed on an outer peripheral surface opposite to the key insert side in the rotor 30. Two convex portions 36 extending in a circumferential direction are formed at an interval of substantially 180°.

As shown in FIG. 1, a groove 37 to guide the tumbler 50 in a radial direction is formed in the rotor 30. In this preferred embodiment, eight tumblers 50 are arranged alternately and eight grooves 37 are formed.

(Tumbler 50)

Each tumbler 50 is biased in the outer circumferential direction by a spring 51 for a tumbler housed in each groove 37 respectively. An engaging groove 41 to be engaged with an edge of the outer radial direction of each tumbler 50 is formed in the sleeve 40 and, in the state shown in FIG. 2, the rotor 30 and the sleeve 40 rotate integrally by engaging with each tumbler 50 biased to the outer radial direction. A hole 52 corresponding to the regular key 200 is formed in each tumbler 50 and each tumbler 50 moves in the radial direction in accordance with a groove shape of the key inserted to the rotor 30. As shown in FIG. 3, when the regular key 200 is inserted, all tumblers 50 are separated from the sleeve 40 and the engagement is released, as a result, the rotor 30 and the sleeve 40 are movable independently.

(Sleeve 40)

As shown in FIG. 1, the sleeve 40 is in a substantially cylindrical shape and a pair of engaging grooves 41 extending in the axial direction are formed on a side surface. Furthermore, a receiving groove 42 to receive the slide bar 70 to be movable in the axial direction is formed on the side surface of the sleeve 40. In this preferred embodiment, two the slide bars 70 are provided, and the engaging groove 41 and the receiving groove 42 are arranged alternately at an interval of substantially 90°.

Here, the engaging grooves 41 formed on the side surface opposite to the sleeve 40 for engaging with each tumbler 50 are different shapes in a front-back direction of the axial direction of the key insert hole 31. Furthermore, as described above, although the engaging grooves 41 are formed on the side surface opposite to the sleeve 40, for example formed in a vertical direction in FIG. 2, the shapes are also different in his vertical direction.

Figure 4A:
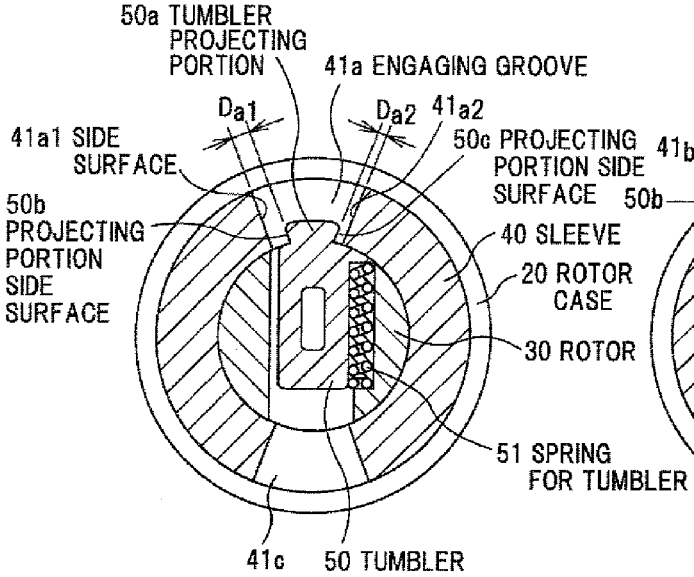
Figure 4B:
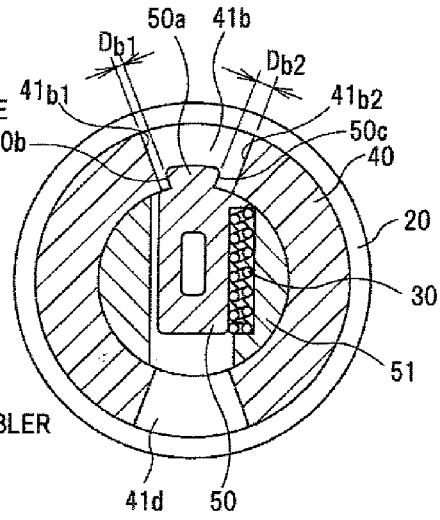
Figure 4C:
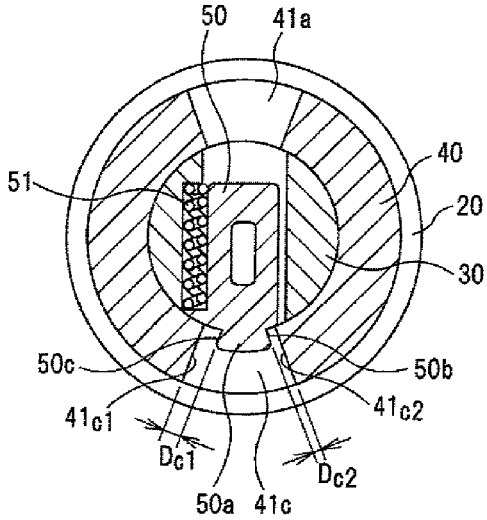
Figure 4D:
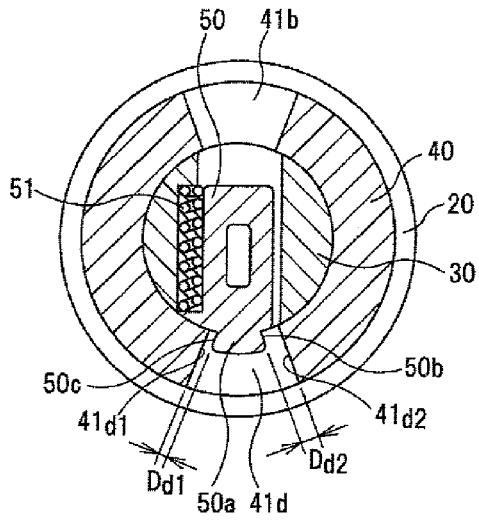

FIGS. 4A, 4B, 4C and 4D are cross sectional views at each position in FIG. 2, wherein FIG. 4A is along A-A line, FIG. 4B is along B-B line, FIG. 4C is along C-C line and FIG. 4D is along D-D line. The angle and the size of the engaging grooves 41*a*, 41*b*, 41*c* and 41*d* shown in each cross section are different.

As shown in FIG. 4A, the engaging groove 41*a* is formed so that a distance Da1 between a projecting portion side surface 50*b* of a tumbler projecting portion 50*a* and a side surface 41*a*1 of the engaging groove 41*a* is different from a distance Da2 between a projecting portion side surface 50*c* and a side surface 41*a*2 with respect to the initial position of the tumbler 50 in a rotation direction. Similarly, the engaging groove 41*b* is formed so that a distance Db1 between a projecting portion side surface 50*b* and a side surface 41*b*1 is different from a distance Db2 between a projecting portion side surface 50*c* and a side surface 41*b*2 with respect to the initial position of the tumbler 50 in a rotation direction as shown in FIG. 4B. For example, it is configured to be Da1>Da2 and Db1<Db2. Therefore, the engaging grooves 41*a* and 41*b* are formed with a predetermined angular difference in a rotation direction (circumferential direction) of the sleeve 40.

As shown in FIG. 4C, the engaging groove 41*c* is formed so that a distance Dc1 between a projecting portion side surface 50*c* of a tumbler projecting portion 50*a* and a side surface 41*c*1 of the engaging groove 41*c* is different from a distance Dc2 between a projecting portion side surface 50*b* and a side surface 41*c*2 with respect to the initial position of the tumbler 50 in a rotation direction. Similarly, the engaging groove 41*d* is formed so that a distance Dd1 between a projecting portion side surface 50*c* and a side surface 41*d*1 is different from a distance Dd2 between a projecting portion side surface 50*b* and a side surface 41*d*2 with respect to the initial position of the tumbler 50 in a rotation direction as shown in FIG. 4D. For example, it is configured to be Dc1>Dc2 and Dd1<Dd2. Therefore, the engaging grooves 41*c* and 41*d* are formed with a predetermined angular difference in a rotation direction (circumferential direction) of the sleeve 40.

(Slide Bar 70)

As shown in FIG, each slide bar 70 is formed in a substantially T-shape and provided with an axial direction extending portion 71 extending in an axial direction received in the receiving groove 42 of the sleeve 40, and a circumferential direction extending portion 72 extending in a circumferential direction at an edge of the clutch member 80 side of the axial direction extending portion 71. Each slide bar 70 moves in the axial direction toward the lever member 60 each time the sleeve 40 rotates relatively only at a predetermined angle with respect to the rotor case 20. In this preferred embodiment, the predetermined angle is 180°.

Figure 5:
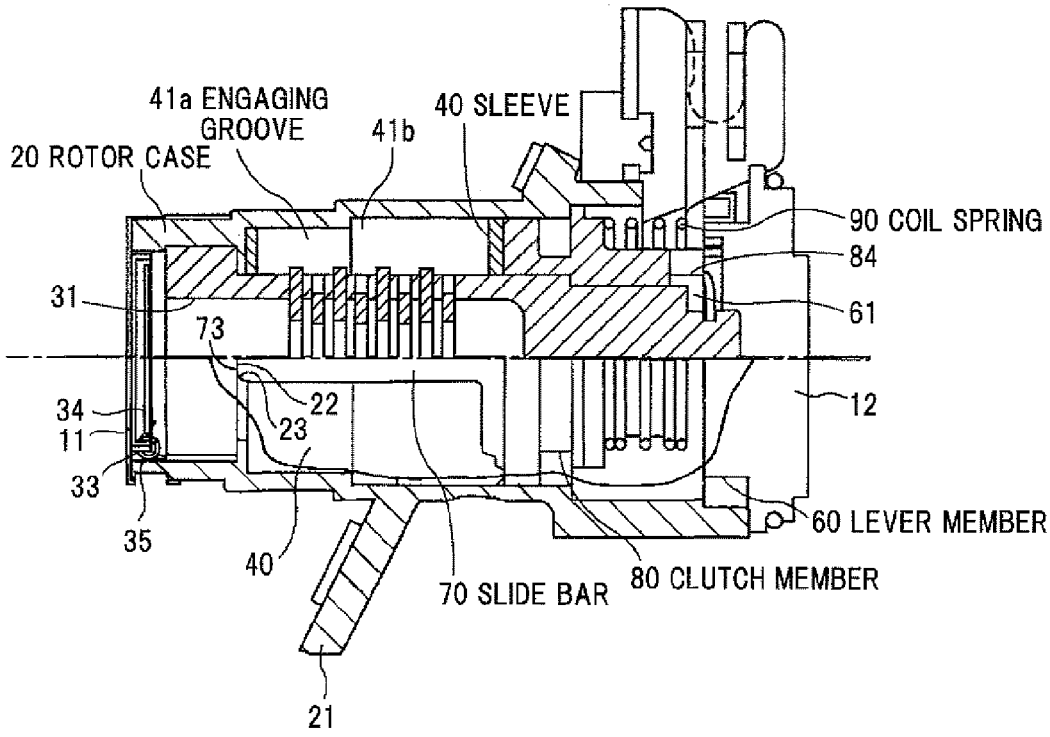
FIG. 5 is a vertical cross-sectional view of the cylinder lock device in the initial state (the state that a key is not inserted).

FIG. 5 is a vertical cross-sectional view of the cylinder lock device in the initial state (the state that a key is not inserted). However, in FIG. 5 only the rotor case 20 is shown as a cross section within a break line in the lower part, and a sleeve and a slide bar or the like are not shown as a cross section. Furthermore a hatching is appropriately omitted in the drawing. As shown in FIG. 5, inside of the rotor case 20 is formed in a step-like shape such that inner diameter is varied, and an end surface 73 opposite to the circumferential direction extending portion 72 in the axial direction extending portion 71 slidably contacts to a step-like shaped sliding surface portion 22 of the rotor case 20. A concave portion 23 is formed at a predetermined position of the sliding surface portion 22 extending in a circumferential direction. Here, since both edges in a circumferential direction of the end surface 73 and the concave portion 23 of each slide bar 70 are inclined, each slide bar 70 is smoothly inserted into and extracted from the concave portion 23 when they move relatively in a circumferential direction. Namely, the cylinder lock device 1 comprises a cam mechanism having a sliding surface portion 22 formed on the rotor case 20 and an end surface 73 as a sliding contact portion formed on the slide bar 70 slidably contacting with the sliding surface portion 22, wherein this cam mechanism moves the slide bar 70 in the axial direction when the sleeve 40 rotates to the rotor case 20 relatively.

The circumferential direction extending portion 72 contacts with the clutch member 80 biased by the coil spring 90 and each slide bar 70 is biased to the key insert side together with the clutch member 80. Each slide bar 70 is engaged with the concave portion 23 of the rotor case 20 by this biasing force in the initial state, and each slide bar 70 moves in the axial direction toward the lever member 60 being extracted from the concave portion 23 against the biasing force when then sleeve 40 rotates relatively with respect to the rotor case 20 in the initial state. In this way, the slide bar 70 separates the clutch member 80 from the lever member 60 by moving in the axial direction along with the sliding surface portion 22. Namely, the above-mentioned disengagement mechanism comprises a clutch member 80, a sliding surface portion 22 formed on the rotor case 20 and each slide bar 70. Here, as shown in FIG. 1, the edge of the clutch member 80 side of the sleeve 40 is notched so as to correspond to the circumferential direction extending portion 72 of the slide bar 70.

As shown in FIG. 1, the clutch member 80 is in a substantially circular plate shape and a receiving hole 82 to receive an edge side of The rotor 30 is formed in its center. A cylindrical portion 83 extending toward the lever member 60 is formed in the clutch member 80 and a plurality of connecting portions 84 are formed by projection at the edge of the cylindrical portion 83. Each connecting portion 84 is inserted into the through-hole 61 formed on the lever member 60, so that the clutch member 80 is provided to be movable in the axial direction toward the lever member 60.

Furthermore, a plurality of notches 85 for aligning the position with respect to the rotor case 20 are formed in multiple positions at the outer periphery of the clutch member 80. Here, in this preferred embodiment, the clutch member 80 is disengaged with the rotor 30 by moving in the axial direction.

The coil spring 90 is wound around the cylindrical portion 83 and the connecting portion 84 of the clutch member 80, and sandwiched by a surface of the lever member 60 side of the clutch member 80 and a surface of the rotor 30 side of the lever member 60. The lever member 60 is configured to be rotatable and doors of a vehicle are locked or unlocked by a rotation of the lever member 60. The doors may be locked or unlocked, for example, directly by connecting a wire for a door lock to the lever member 60, or indirectly by providing a switch to detect a rotation angle of the lever member 60.

(Locking and Unlocking Operation by a Regular Key)

According to this cylinder lock device 1, when the regular key 200 is inserted into the key insert hole 31, the tumbler projecting portions 50*a* of all tumblers 50 are housed in the rotor 30 and the engagement of the tumbler 50 with the sleeve 40 is released, as a result, the rotor 30 and the sleeve 40 are rotatable independently. When the key is rotated in this state, the clutch member 80 engaged with the rotor 30 rotates together with the lever member 60 and it is possible to conduct the locking and unlocking operation.

(Locking and Unlocking Operation by an Unauthorized Key)

Furthermore, when a foreign object such as an unauthorized key, a screwdriver or the like is inserted in the key insert hole 31, since the tumbler projecting portions 50*a* of all tumblers 50 are not housed in the rotor 30 and the tumbler projecting portions 50*a* and the sleeve 40 remain engaged, the engagement of the tumbler 50 with the sleeve 40 is not released, as a result, the rotor 30 and the sleeve 40 rotate integrally when the key is rotated in this state, the sleeve 40 rotates together with the rotor 30 from the initial position with respect to the rotor case 20, the slide bar 70 moves to the lever member 60 side and the engagement of the clutch member 80 with the rotor 30 is released. As a result, only the rotor 30 and the sleeve 40 rotate even if the key is rotated, thus, it is not possible to lock or unlock.

(Control of Picking Action)

Although FIG. 2 shows the locking state, a picking action to unlock illegally may be carried out using a rod-like tool to release an engagement of she tumbler 50 with the sleeve 40 by operating a plurality of tumblers 50 in this state. In the picking action, the tumbler projecting portions 50*a* of all tumblers 50 are contacted with the engaging grooves 41 of the sleeve 40 by rotating the rotor 30 in one direction, the tumbler projecting portions 50*a* of all tumblers 50 are moved in the rotor 30 in this contact state, and the engagement of the tumbler 50 with the sleeve 40 is released by conducting this operation to all tumblers 50. It is to unlock illegally by rotating the clutch member 80 engaged with the rotor 30 width the lever member 60 by rotating the rotor 30 in this state.

In the cylinder lock device 1 in the preferred embodiment according to the present invention, as shown in FIG. 2 or FIG. 4, engaging grooves 41 (41*a* to 41*d*) for engaging with each tumbler 50 are different shapes in a front-back direction of the axial direction of the key insert hole 31, furthermore, also shapes different in a vertical direction. Following will be an explanation in conjunction with FIGS. 4A to 4D.

Although FIG. 4A shows a cross section along A-A line in FIG. 2, a distance between the tumbler projecting portion 50*a* and the engaging groove 41*a* is configured to be Da1>Da2 with respect to the initial position of the tumbler 50 in a rotation direction. Therefore, for example, when the rotor 30 is rotated in clockwise direction in FIG. 4A, the projecting portion side surface 50*c* contacts With the side surface 41*a*2, thus, it is possible to release the engagement of the tumbler 50 with the sleeve 40 by operating the tumbler 50 in a direction to be housed inside the rotor 30 in his contact state.

Meanwhile, in a cross section along B-B line in FIG. 2 shown in FIG. 4B, a distance between the tumbler projecting portion 50*a* and the engaging groove 41*b* is configured to be Db1<Db2 with respect to the initial position of the tumbler 50 in the rotation direction. Therefore, since the projecting portion side surface 50*c* does not contact with the side surface 41*b*2 and is not held by friction even though the tumbler 50 is operated it is not possible to house the tumbler 50 inside the rotor 30, thus, it is not possible to release the engagement of the tumbler 50 with the sleeve 40.

Contrary to the above, when the rotor 30 is rotated in counterclockwise direction in the FIG. 4A, the projecting portion side surface 50*b* does not contact with the side surface 41*a*1, on the other hand, the projecting portion side surface 50*b* contacts with the side surface 41*b*1 in the cross section along B-B line in FIG. 2 shown in FIG. 4B. As seen from then above, since at least any of the tumblers 50 do not contact with the engaging groove 41 of the sleeve 40 no matter in which direction the rotor 30 is rotated, it is difficult to release the engagement of all tumblers 50 with the sleeve 40.

Although it is explained that the above-mentioned picking action control is an effect by which the engaging grooves 41 (41*a* and 41*b*) for engaging with the tumblers 50 are different shapes in the front-back direction of the axial direction of the key insert hole 31, the same effect is achieved in the vertical direction since the engaging grooves 41 (41*c* and 41*d*) are different shapes.

Although FIG. 4C shows a cross section along C-C line in FIG. 2, a distance between the tumbler projecting portion 50*a* and the engaging groove 41*c* is configured to be Dc1>Dc2 with respect to the initial position of the tumbler 50 in a rotation direction. Therefore, for example, even though the rotor 30 is rotated in a clockwise direction in FIG. 4C, the projecting portion side surface 50*c* in a cross section along D-D line in FIG. 2 shown in FIG. 4D contacts with the side surface 41*d*1 in first as described below. Therefore, since the projecting portion side surface 50*c* does not contact with the side surface 41*c*1 and is not held by friction even though the tumbler 50 is operated, it is not possible to house this tumbler 50 inside the rotor 30, thus, it is difficult to release the engagement of the tumbler 50 with the sleeve 40.

Meanwhile, in the cross section along D-D line in FIG. 2 shown in FIG. 4D, a distance between the tumbler projecting portion 50*a* and the engaging groove 41*d* is configured to be Dd1<Dd2 with respect to the initial position of the tumbler 50 in the rotation direction. Therefore, the projecting portion side surface 50*c* contacts with the side surface 41*d*1 and it is possible to release the engagement of the tumbler 50 with the sleeve 40 by operating the tumbler 50 in a direction to be housed inside the rotor 30 in this contact state.

Contrary to the above, when the rotor 30 is rotated in counterclockwise direction in the FIG. 4C, the projecting portion side surface 50*b* contacts with the side surface 41*c*2, on the other hand, the projecting portion side surface 50*b* does not contact with the side surface 41*d*2 in the cross section along D-D line in FIG. 2 shown in FIG. 4D. As seen from then above, since at least any of the tumblers 50 do not contact with the engaging grooves 41 of the sleeve 40 no matter in which direction the rotor 30 is rotated, it is difficult to release the engagement of all tumblers 50 with the sleeve 40.

As described above, the engaging grooves 41 (41*a* to 41*d*) for engaging with the each tumbler 50 are different shapes in the front-back direction of the axial direction, furthermore, also different shapes in the vertical direction of the key insert hole 31, it is extremely difficult to release the engagement of all tumblers 50 with the sleeve 40 by operating all tumblers 50.

Furthermore, for example as shown in FIG. 4A, since the side surfaces of the projecting portions 50*b* and 50*c* are formed oblique to the moving direction of the tumblers 50 in the tumbler projecting portions 50*a* of die tumblers 50, the sleeve 40 rotates when ting to move the tumblers 50 in a direction to be housed inside the rotor 30 by a picking operation. As a result, since the contact between other tumblers 50 and the sleeve 40 is released, it is extremely difficult to conduct the picking operation of multiple tumblers 50 at the same time.

Although the cylinder lock device 1 to lock and unlock doors of a vehicle is exemplified in the above-mentioned preferred embodiment, it may be the cylinder lock device 1 to lock and unlock, for example, a door of a house, a drawer or the like.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A cylinder lock device, comprising:

a rotor case in a cylindrical shape;

a rotor arranged to be rotatable inside the rotor case and including a key insert hole formed to extend in an axial direction of the rotor;

a sleeve arranged to be rotatable between the rotor case and the rotor and having an engaging groove; and at least two tumblers provided in the axial direction in the rotor to be movable outward in a radial direction of the rotor to engage the engaging groove of the sleeve when biased outward in the radial direction of the rotor, the at least two tumblers being moved inward in the radial direction of the rotor to release the engagement with the sleeve by being disengaged from the engaging groove when a regular key is inserted into the key insert hole, wherein a position of the engaging groove of the sleeve in a circumferential direction of the sleeve is different between the at least two tumblers so that a side surface of the engaging groove of the sleeve is configured to contact a tumbler of the at least two tumblers but not contact a remaining tumbler of the at least two tumblers, when the at least two tumblers are rotated from an initial position in a clockwise or counterclockwise direction.

2. The cylinder lock device according to claim 1, wherein the engaging groove of the sleeve is configured to include two types of contact locations in a front-back direction of the axial direction of the key insert hole.

3. The cylinder lock device according to claim 1, wherein the engaging groove of the sleeve is configured to be two types of contact location in a vertical direction of the axial direction of the key insert hole.

4. The cylinder lock device according to claim 1, wherein the engaging groove is formed so that a distance between a projecting portion side surface of a tumbler projecting portion and a side surface of the engaging groove and a distance between another projecting portion side surface of the tumbler projecting portion and another side surface of the engaging groove are different in size in a circumferential direction with respect to the initial position of the tumbler.

5. The cylinder lock device according to claim 1, wherein the engaging groove is formed with a predetermined angular difference with respect to another engaging groove in a circumferential direction of the sleeve.

6. The cylinder lock device according to claim 1, wherein the tumbler is formed so that the projecting portion side surface of the tumbler projecting portion of the tumbler is inclined with respect to a moving direction of the tumbler.

7. A cylinder lock device, comprising:

a rotor arranged to be rotatable including a key insert hole formed to extend in an axial direction of the rotor;

a sleeve having an engaging groove including a side surface; and at least two tumblers provided in the axial direction in the rotor to be movable outward in a radial direction of the rotor to engage the engaging groove of the sleeve when biased outward in the radial direction of the rotor, the at least two tumblers being moved inward in the radial direction of the rotor to release the engagement with the sleeve by being disengaged from the engaging groove when a regular key is inserted into the key insert hole, wherein a position of the engaging groove of the sleeve in a circumferential direction of the sleeve is different between the at least two tumblers so that the side surface of the engaging groove is configured to contact a tumbler of the at least two tumblers but not contact a remaining tumbler of the at least two tumblers, when the at least two tumblers are rotated from an initial position in a clockwise or counterclockwise direction.

* * * * *